US005639130A

United States Patent [19]

Rogers, Jr. et al.

[11] Patent Number: 5,639,130

[45] Date of Patent: Jun. 17, 1997

[54] ROTARY DOOR CINCHING MECHANISM WITH MANUAL OVERRIDE

[75] Inventors: Lloyd Walker Rogers, Jr., Shelby; John Ion Moceanu, Sterling Heights; Robert Wayne Baughman, Mount Clemens, all of Mich.

[73] Assignee: General Motors Corporation, Detroit, Mich.

[21] Appl. No.: 456,089

[22] Filed: May 31, 1995

[51] Int. Cl.[6] ..... E05C 3/26

[52] U.S. Cl. ..... 292/216; 292/199; 292/201; 292/DIG. 23

[58] Field of Search ..... 292/216, 201, 292/198, 199, DIG. 23

[56] References Cited

U.S. PATENT DOCUMENTS

| | | | |
|---|---|---|---|
| 2,898,138 | 8/1959 | Van Noord | 292/122 |
| 3,713,472 | 1/1973 | Dozois | 160/189 |
| 4,395,064 | 7/1983 | Bellot et al. | 292/201 |
| 4,518,180 | 5/1985 | Kleefeldt et al. | 292/201 |
| 4,518,181 | 5/1985 | Yamada | 292/201 |
| 4,569,544 | 2/1986 | Escaravage | 292/216 |
| 4,664,430 | 5/1987 | Bernard | 292/201 |
| 4,763,936 | 8/1988 | Rogakos et al. | 292/201 |
| 4,796,932 | 1/1989 | Tame | 292/112 |
| 4,806,712 | 2/1989 | Hoffman et al. | 200/61.62 |
| 4,948,183 | 8/1990 | Yamada | 292/199 |
| 5,277,461 | 1/1994 | Dzurko et al. | 292/216 |

*Primary Examiner*—Steven N. Meyers
*Assistant Examiner*—Donald J. Lecher
*Attorney, Agent, or Firm*—Jeffrey A. Sedlar

[57] ABSTRACT

A cinching mechanism for interaction with a substantially conventional latch assembly includes a cinching gear selectively power driven by an actuator and includes a link between the cinching mechanism and the latch assembly providing a means of manually releasing the cinching mechanism to permit the latch assembly to open regardless of the condition of the cinching mechanism.

7 Claims, 8 Drawing Sheets

ROTARY DOOR CINCHING MECHANISM WITH MANUAL OVERRIDE

BACKGROUND OF THE INVENTION

The present invention relates to vehicle closure element latches and more particularly, to a cinching mechanism for associating with a latch to provide a motive force in automatically driving the door latch between operative positions.

It is known to provide a cinching mechanism for power operation of a latch to assist vehicle users in closing a door, hatch or similar component (referred to in the aggregate as closure elements), against weather seal pressure. A primary consideration is that power driving a closure element through its final pivoting motion to a fully closed position is opposed by a considerable force. This force arises due to a need to compress a weather seal interposed between the closure element and the vehicle body in addition to the possible presence of such features as rubber bumpers serving to reduce rattling between the closure element and the vehicle body.

The prior art has generally developed functional mechanisms for power driving a latch, one of which is disclosed in U.S. Pat. No. 4,763,936 entitled "Power Operated Door Latch" which issued Aug. 16, 1988. This type of device entails redesigning the latch assembly itself in order to incorporate the power drive mechanism.

It has been found that it is preferable to design a cinching mechanism which can be incorporated with a standard latch assembly with minimal changes thereto. A complicating factor in providing such a cinching mechanism is the fact that the latch will preferably continue to operate in a manual mode in addition to a power mode.

SUMMARY OF THE INVENTION

The present invention provides a cinching mechanism to supply power actuation to a conventional vehicle latch while requiring minimal changes to the latch structure itself. According to an aspect of the present invention, the cinching mechanism operates to move a forkbolt of the latch from a secondary position to a fully closed position. The cinching mechanism is designed to operate with a substantially conventional vehicle door latch as disclosed in U.S. Pat. No. 5,277,461 entitled "Vehicle Door Latch" which issued Jan. 11, 1994 and is commonly assigned. U.S. Pat. No. 5,277,461 is specifically incorporated herein by reference.

When the closure element which carries the latch is slowly closed, either manually or automatically, to a secondary position of the latch, as indicated by the position of the forkbolt, the cinching mechanism according to the present invention automatically operates, providing a motive force to continue to rotate the forkbolt to a primary latched position. This provides a powered means to fully close the closure element and compress the weather seal and engage the closure element against any rubber bumpers that may be used. The cinching mechanism also provides a means to provide a power unlatching mechanism wherein the cinching mechanism drives the forkbolt from a fully closed position to release it to an open position.

The present invention provides the advantage in-that, if the cinching mechanism fails to automatically operate, the closure element can be manually opened by conventionally, manually releasing the latch to an open position. This can be accomplished regardless of the operative position of the cinching mechanism.

According to an aspect of the present invention the cinching mechanism drives the forkbolt by providing a series of gears formed in the perimeter of the forkbolt which engage a cinching gear driven by a nonbackdriveable actuator such as an electric motor in combination with a gear box. The forkbolt operates to hold the closure element in a closed position or to release it into an open position by interacting with a conventional striker rigidly mounted to the vehicle structure.

During closure, when the forkbolt is moved to a secondary position, a switch in the cinching mechanism automatically powers the motor which provides motive force to rotate the cinching mechanism and drive the forkbolt. When the forkbolt is driven to the primary latched position a detent lever engages the forkbolt to hold it in this position. At substantially the same time a switch stops rotation of the motor, at which point the motor's direction of rotation is reversed, driving the cinching mechanism in the opposite direction until an additional switch operates to shut-off power to the motor.

The latch can be automatically moved to an unlatched position through power operation of the cinching mechanism. In addition, the latch may be manually released in a conventional manner by actuating a rod which operates to disengage the detent lever from the forkbolt. This permits the forkbolt to rotate which releases the striker and allows the closure element to open.

The present invention provides an advantage in-that the cinching mechanism is designed such that minimal changes are required to the latch mechanism itself. Accordingly, the specific configuration of the invention will change to match the latch to which is applied, with the basic operating principles remaining constant. Therefore, the present invention provides a design which is flexible in nature and which is cost conscious.

DETAILED DESCRIPTION OF THE PRESENTLY PREFERRED EMBODIMENT

Figure 1:
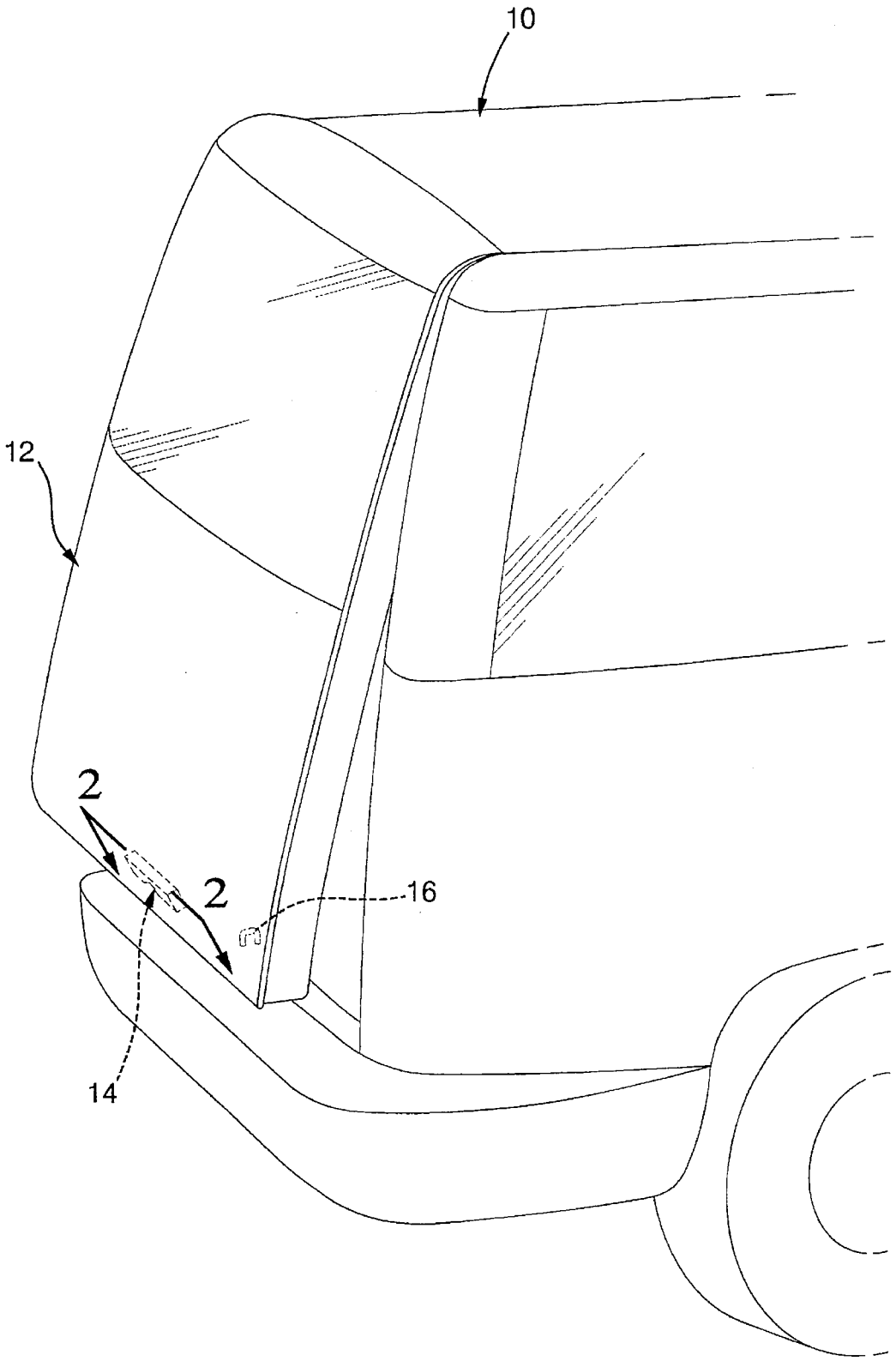
FIG. 1 is a fragmentary perspective view of the lift-gate area of a vehicle.

FIG. 1 illustrates the rear area of a vehicle 10 which shows a liftgate 12 in a slightly ajar position. The liftgate 12 may be manually operable in a conventional manner or may include a power drive mechanism to assist in automatically opening and closing the liftgate. The liftgate 12 carries a latch assembly 14 which engages a striker 16 that is carried by the vehicle 10. The latch assembly 14 and striker 16 operate in a conventional manner to hold the liftgate 12 in a closed position and provide a means of releasing the liftgate 12 for opening.

Figure 2:
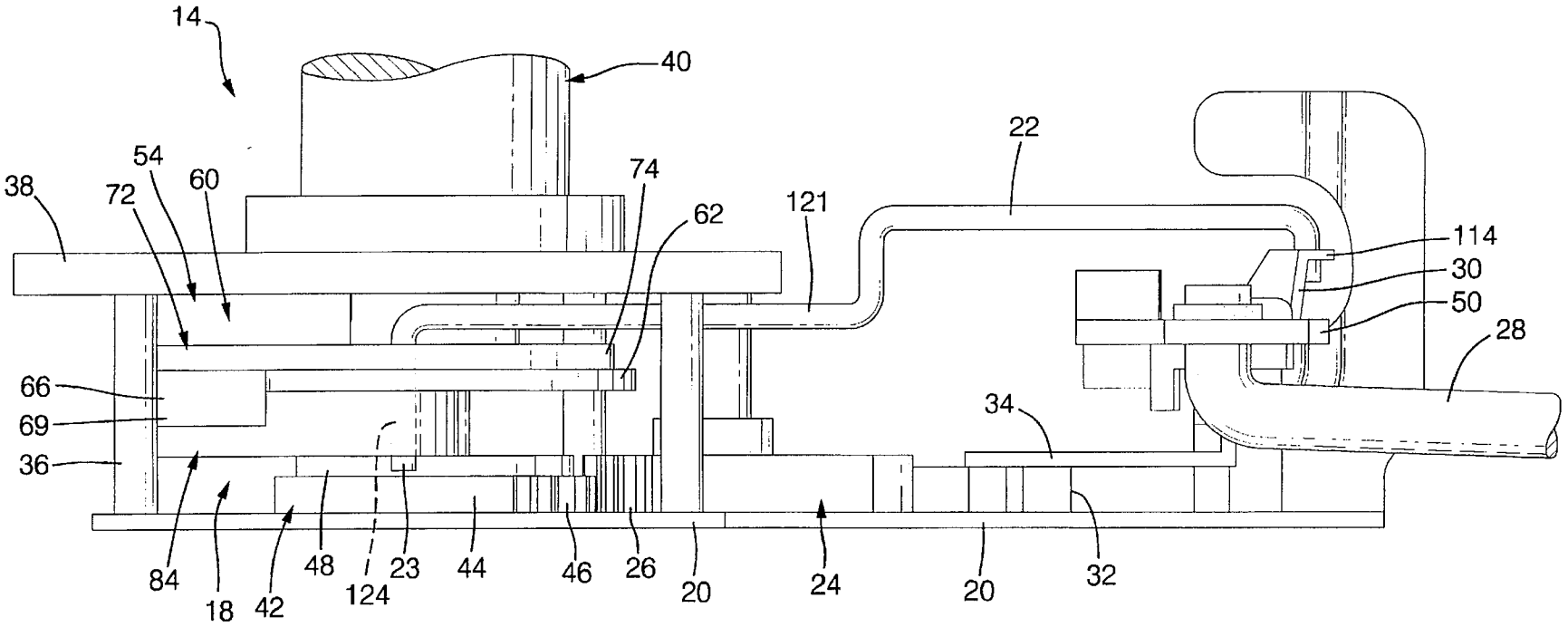
FIG. 2 is a cross-sectional view through a cinching mechanism as applied to a latch assembly taken generally through the plane indicated by the line 2—2 in FIG. 1.

According to the present invention, the latch assembly 14 is of a substantial conventional manner as is disclosed in U.S. Pat. No. 5,277,461. The latch is modified to incorporate a cinching mechanism 18, as shown in FIG. 2, by extending the latch's frame 20 and providing a means for engaging links such as link 22. In addition, the forkbolt 24 is modified by providing gears 26 on its outer perimeter for engagement with the cinching mechanism 18 as is most clearly illustrated in FIG. 3. Pin 25 is modified to extend between the frame 20 and a plate 38. Those components of the substantially conventional latch assembly 14 critical to describing the present invention are illustrated.

Figure 4:
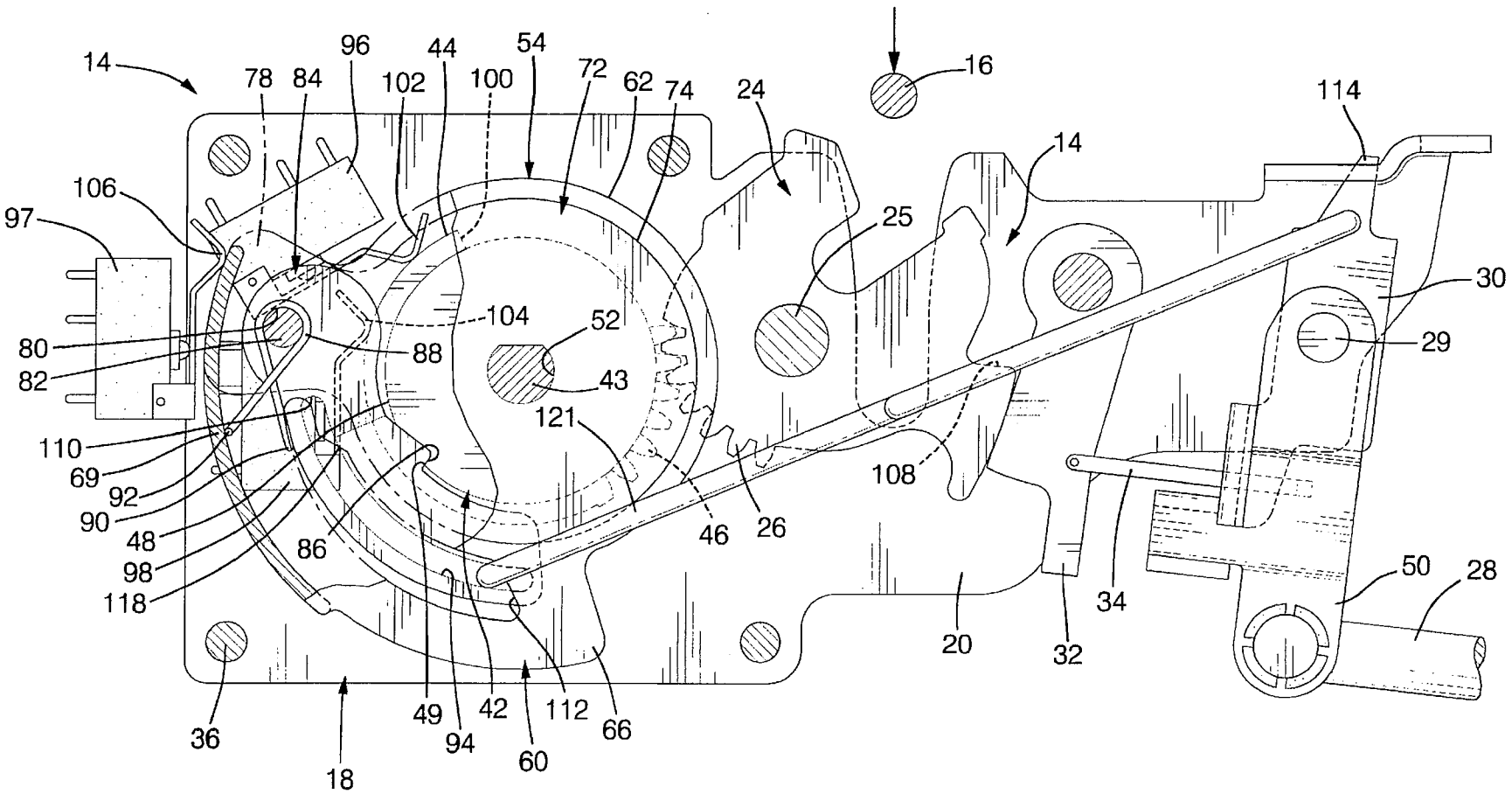
FIG. 4 is a fragmentary view of a cinching mechanism with the latch forkbolt in the fully open position and the cinching mechanism in the stand-by condition.

A rod 28 which is driven by a conventional manual mechanism (not illustrated) engages operating lever 50 in a conventional manner. Operating lever 50 is pivotally movable about a pin 29, as shown in FIG. 4, by the rod 28 and is operable to release the forkbolt 24 from a fully closed position to an open position by means of selectively engaging link 34 which is fixed to detent lever 32. The operating lever 50 engages an intermediate lever 30 which is also pivotally mounted on pin 29. The link 34 engages the intermediate lever 30 and is operable to pivot the detent lever 32 out of engagement with the forkbolt 24 by either the operation of operating lever 50 or the intermediate lever 30.

The detent lever 32 selectively engages forkbolt 24 to hold it in a fully closed position. The detent lever 32 is manually releasable to open the forkbolt 24 through operation of the rod 28, operating lever 50 and link 34. In addition, link 22 extends between the intermediate lever 30 and the cinching mechanism 18 providing a means for automatic release of the detent lever 32. When the forkbolt 24 is released from the detent lever 32, a conventional spring as shown in phantom in FIG. 4, causes the forkbolt to rotate to the fully open position.

The frame 20 carries a plurality of posts, representative of which is post 36, for spacing apart the plate 38 and interconnecting it with the frame 20 for carrying the cinching mechanism 18. A power operated motor and gear box assembly 40 is also carried on plate 38 for interacting with the rest of cinching mechanism 18 and providing a selectively actuated motive force thereto.

Figure 3:
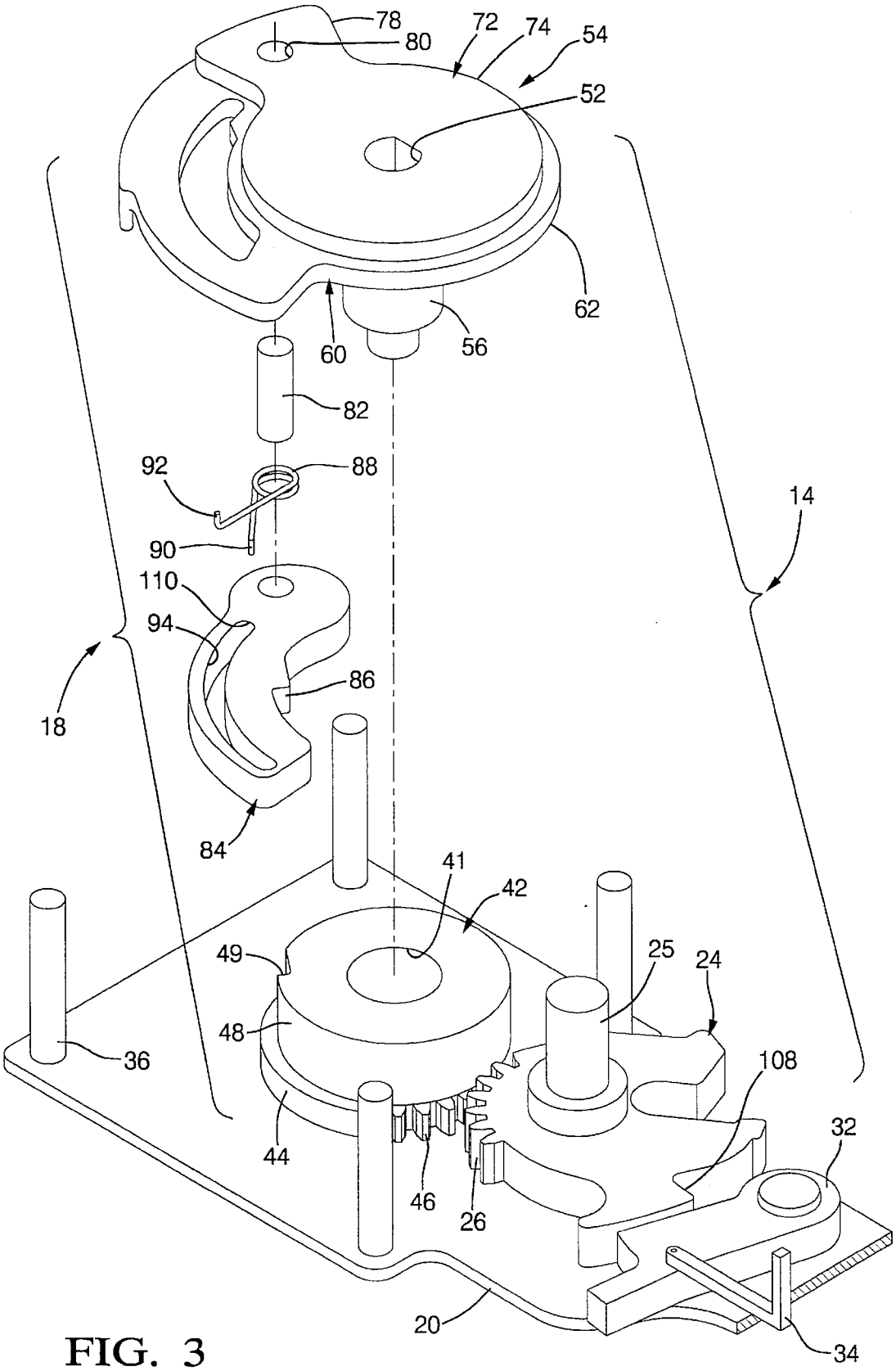
FIG. 3 is a partial exploded view of a cinching mechanism.

Referring to FIG. 3, the cinching gear 42 is pivotally mounted on a journal provided by the extension 56 which is integrally formed with actuator 54. Cinching gear 42 includes an annular base portion 44 with a series of gear teeth 46 for interacting with the gear teeth 26 on forkbolt 24 and an annular body portion 48 which includes a notch 49. The cinching gear 42 is freely rotatable about the extension 56 as limited by the other interacting components of the cinching mechanism 18 and by interaction with the forkbolt 24 of latch assembly 14.

Actuator 54 is mounted on shaft 43 in a keyed relationship therewith due to the "D" shaped opening 52. Shaft 43 extends from motor and gearbox assembly 40 and is driven thereby. Actuator 54 is not capable of back-driving motor and gearbox assembly 40 through shaft 43.

Coaxially disposed with the opening 52 is the extension 56 forming a journal for passing through opening 41 of cinching gear 42 and for rotatably engaging an opening (not illustrated) in frame 20. The actuator 54 is pivotally movable in coordination with the motor and gear box assembly 40 and includes a configuration for operating in a cam-like manner. Actuator 54 includes a base plate 60 which is substantially flat and includes a circular portion 62 and a lobe portion 66. The lobe portion 66 includes an elongated opening 68 and a downwardly directed extension 69.

The base plate 60 is integrally formed with the extension 56 and is also integrally formed with the top plate 72. The opening 52 extends completely through top plate 72 and at least partially into base plate 60. The top plate 72 includes a circular portion 74 from which extends extension 78 over a portion of lobe portion 66 of base plate 60. A circular opening 80 extends through extension 78 and lobe portion 66 and fixedly carries pin 82. The pin 82 is secured in the opening 80 of actuator 54 to prevent rotation relative thereto and extends down against frame 20 or optionally an opening (not illustrated), is provided in frame 20 for the extension of pin 82 thereinto.

A pawl 84 is pivotably carried by pin 82 and includes cam surface 86 shaped for sliding along body portion 48 of cinching gear 42 and engaging notch 49 thereof. Cam surface 86 is biased against cinching gear 42 by a spring 88 which is coiled about pin 82 and includes end 90 for engaging pawl 84 and end 92 for engaging actuator 54. Pawl 84 includes a curved slot 94 into which segment 124 of link 22 extends, (as shown in FIG. 2). Link 22 extends through elongated opening 68 of actuator 54 and extends through curved slot 94 and includes an end 23.

Figure 5:
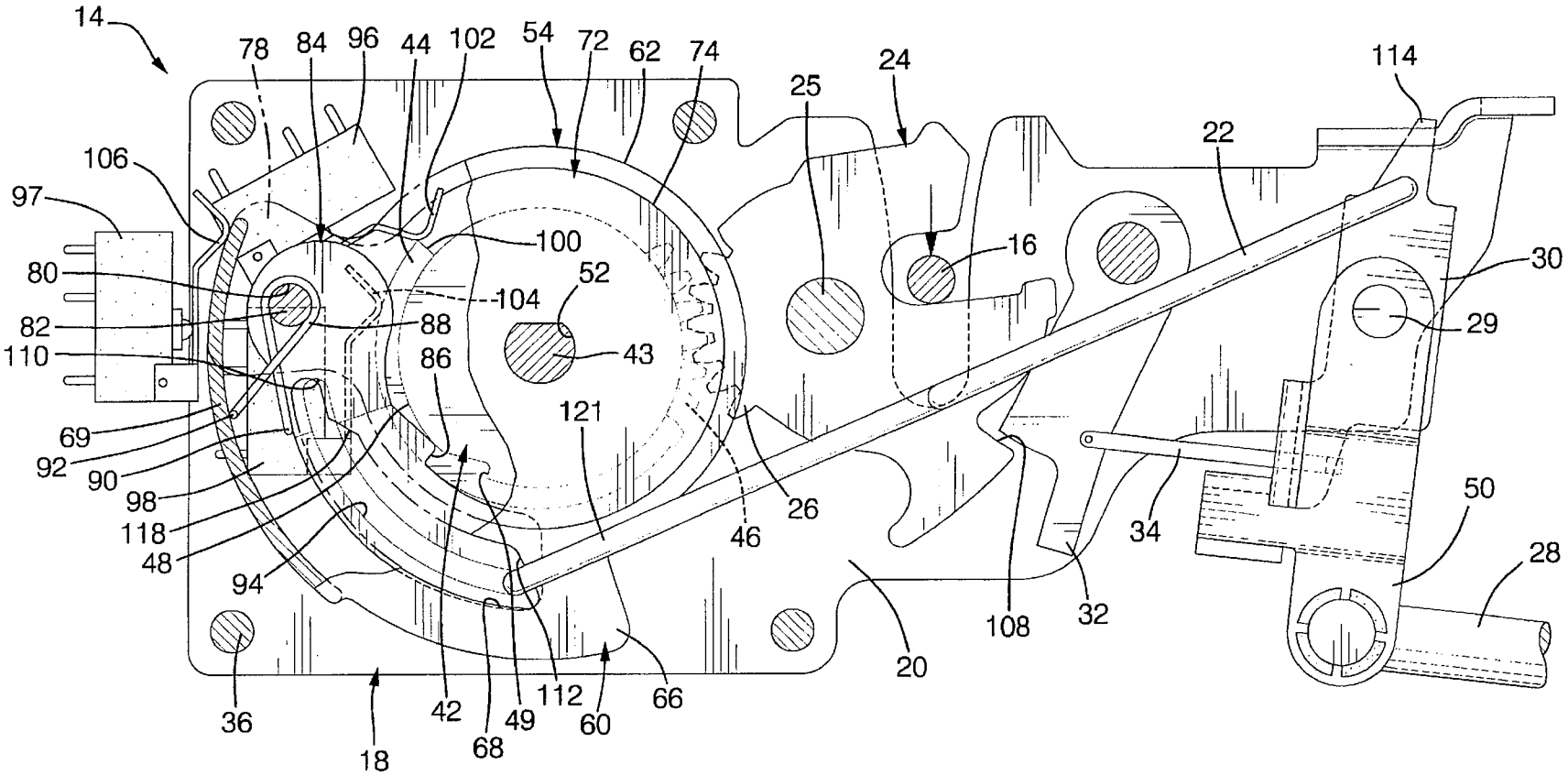
FIG. 5 is a fragmentary view of a cinching mechanism with the latch forkbolt in the secondary position and the cinching mechanism in the stand-by condition.
Figure 6:
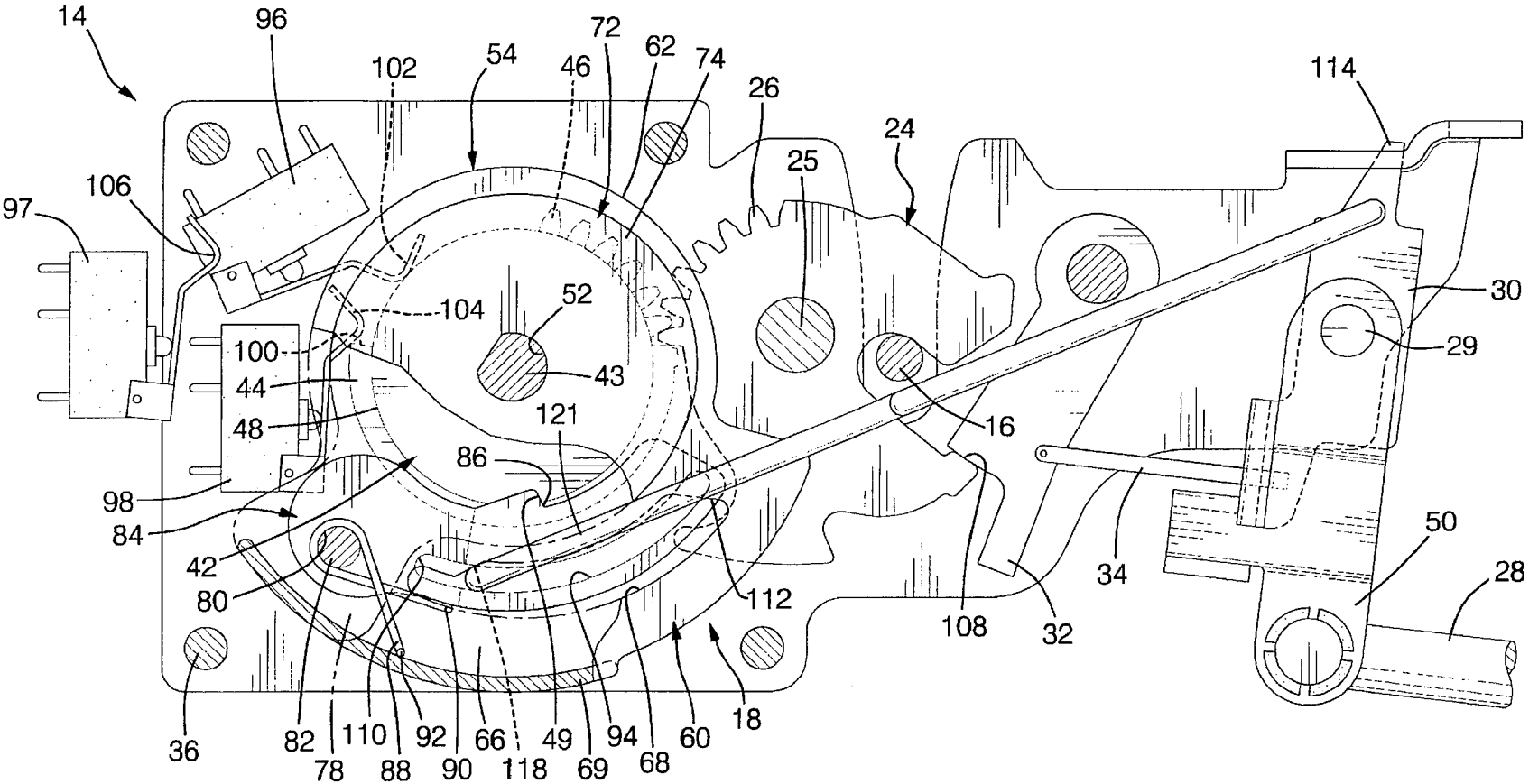
FIG. 6 is a fragmentary view of a cinching mechanism with the latch forkbolt in the fully closed or "primary latched" position and the cinching mechanism in the stand-by condition.
Figure 7:
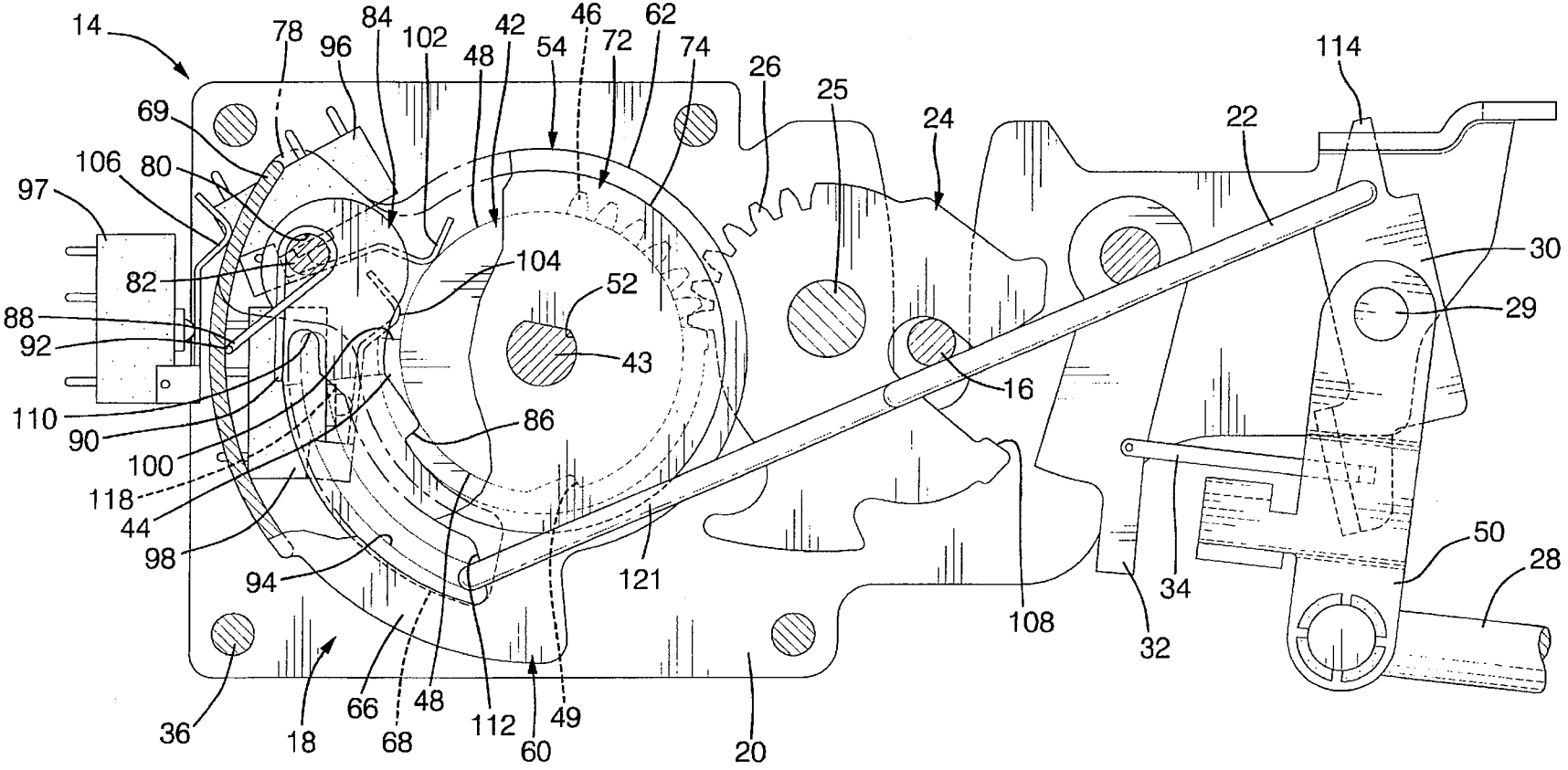
FIG. 7 is a fragmentary view of a cinching mechanism with the latch forkbolt near the primary latched position and the cinching mechanism in an automatic unlatching condition.
Figure 8:
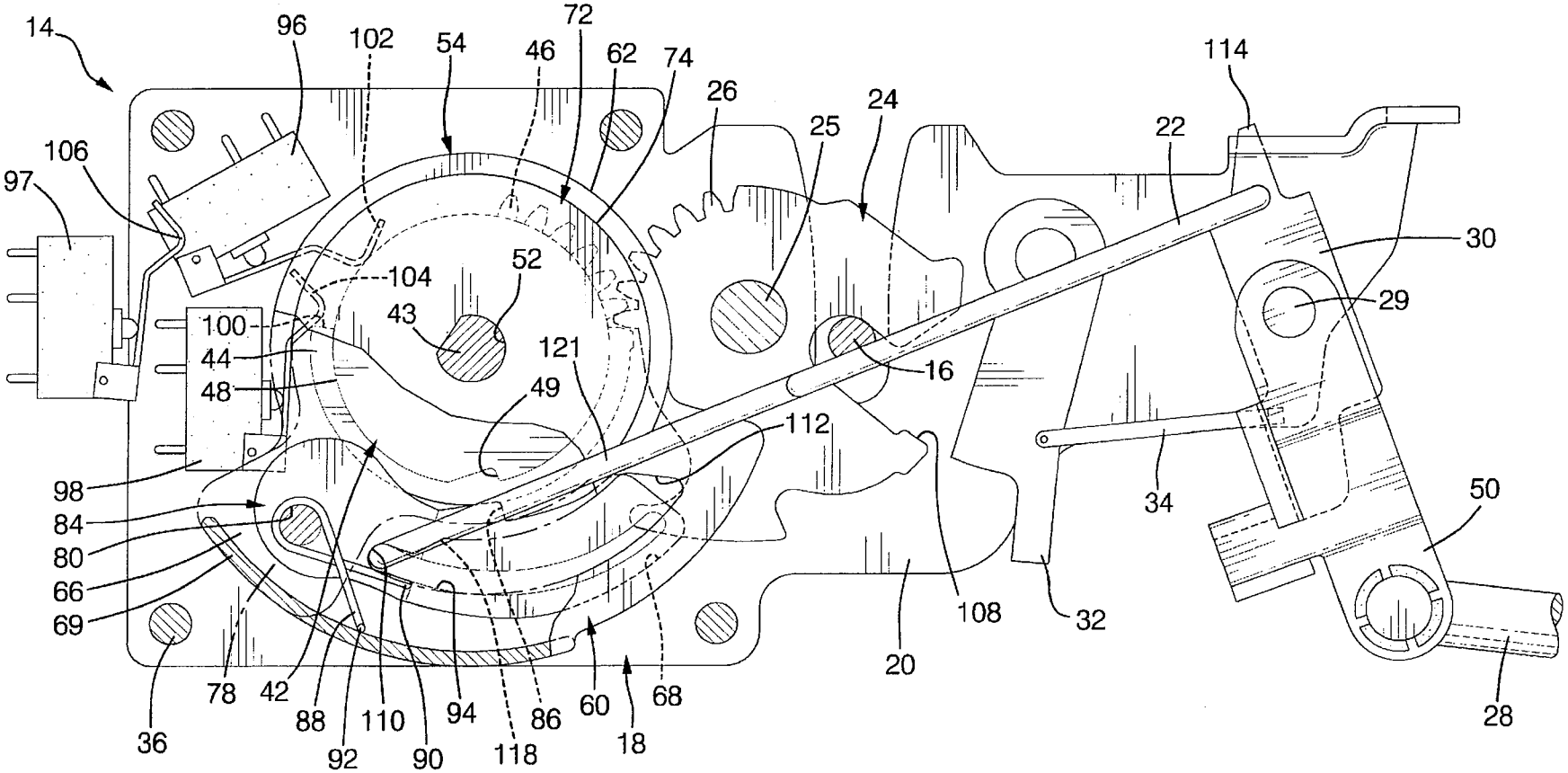
FIG. 8 is a fragmentary view of a cinching mechanism with the latch forkbolt near the primary latched position and the cinching mechanism in a manual unlatching condition.

FIGS. 4–8 illustrate the latch 14 and cinching mechanism 18 in various states of operation. FIG. 4 illustrates the latch in a fully released position and FIG. 5 illustrates the latch in a secondary position. FIGS. 6, 7 and 8 all illustrate the latch in, or substantially in, a fully closed position. The cinching mechanism 18 includes three switches 96, 97 and 98 each securely mounted in position relative to the cinching mechanism 18 and communicating with an electrical control mechanism(not illustrated).

Switch 96 operates in conjunction with the cinching gear 42 and by means of a step 100 in base 44 of cinching gear 42, is operable to effect energization of the cinching mechanism 18 to supply power to the motor and gear box assembly 40 through an appropriate electrical control scheme (not illustrated). Switch 98 also operates in conjunction with the cinching gear 42 and by means of interaction with the step 100 is operable to effect stopping and direction reversal of the motor and gear box assembly 40 through the electrical control mechanism. Switch 97 is operable in conjunction with actuator 54 and through engagement or disengagement with extension 69 of base plate 60 is operable to turn-off power to the motor and gear box assembly 40 thus ceasing automatic operation of the cinching mechanism 18. The extension 69 of actuator 54 includes a cam-like surface relative to the switch 97 to provide the function of interrupting power to the motor and gear box assembly 40 at a selected location in the rotation of actuator 54.

As shown in FIG. 4, the latch assembly 14 is in a fully opened position awaiting selected engagement with the striker 16. When the striker 16 engages the forkbolt 24, clockwise rotation of the forkbolt 24 on the shaft 25 is initiated. The gear 26 of the forkbolt 24 causes counterclockwise rotation of the cinching gear 42 by engagement with the gear 46. This rotates the cinching gear 42 in a counterclockwise direction as viewed in FIG. 4. The cinching gear 42 rotates about the extension 56 of actuator 54 which operates as a journal therefor. During light engagement with the striker 16 the forkbolt 24 rotates from a fully opened position to a secondary position. This corresponds to an engaged condition of the latch 14 with the striker 16 but liftgate 12 remains in a slightly ajar condition. During this portion of movement of the mechanism, the actuator 54 does not rotate and the pawl 84 rides against the body portion 48 of cinching gear 42.

During the counterclockwise rotation of the cinching gear 42 the cam surface 86 of pawl 84 is disengaged from the notch 49 by the base portion 44 pivoting the pawl 84 in a clockwise direction against the force of spring 88. When the forkbolt 24 has arrived in the secondary position as predetermined according to the application, the step 100 of base portion 44 moves past the arm 102 of switch 96, as seen in FIG. 5, which in turn causes the switch 96 to initiate the electrical control mechanism to supply power to the motor and gear box assembly 40. Therefore, in response to lightly manually moving the liftgate 12 to a position wherein the latch 14 engages the striker 16 such that a secondary position of the latch occurs, automatic operation of the cinching mechanism 18 is initiated. This can also occur at a point where a power liftgate moving mechanism (not illustrated), draws the liftgate to such a closed position.

With the motor and gear box assembly 40 now driving the cinching mechanism 18 and continuing in a counterclockwise direction, the actuator 54 rotates, carrying the pawl 84 with it wherein the cam surface 86 of pawl 84 reengages the notch 49 of cinching gear 42 and therefore, provides a power drive mechanism to continue driving cinching gear 42 in the counterclockwise direction. This, in-turn rotates forkbolt 24 in a clockwise direction thus pulling striker 16 within the latch assembly 14 and driving the mechanism to a fully closed position corresponding to the primary latched position. A substantial amount of force is thereby, applied to the striker 16 to pull the liftgate 12 completely closed against the substantial force of the sealing mechanism (not illustrated), and anti-vibration stops (not illustrated), between the vehicle 10 and liftgate 12.

When the forkbolt 24 reaches the primary latched position as shown in FIG. 6, the detent lever 32 engages the primary detent 108 of forkbolt 24. This locks the forkbolt 24 in position and thereby, prevents it from rotating back in a counterclockwise direction and maintains liftgate 12 securely in a fully closed condition.

At this point the arm 104 of switch 98 drops off the step 100 of base 44 on cinching gear 42 and communicates to the electrical control mechanism to cease rotation of the motor and gear box assembly 40. In coordination, the electrical control mechanism reverses the direction of rotation of the motor and gearbox assembly 40 initiating the cinching mechanism 18 to drive in the clockwise direction. The actuator 54 is driven in the clockwise direction until a selected point of engagement between the extension 69 of actuator 54 and the arm 106 of switch 97 operates to cause the electrical control mechanism to interrupt the power to the motor and gear box assembly 40 thus placing the cinching mechanism 18 in a standby condition. This corresponds with FIG. 7 wherein the latch assembly 14 is in the primary latched position and cinching mechanism 18 is in the standby condition.

The present invention provides a means of manually unlatching the latch assembly 14 to release the striker 16. Manual release is initiated by the rod 28 which through a conventional mechanism pulls the operating lever 50 causing it to rotate in a counterclockwise direction as viewed in FIG. 8 which in response, rotates intermediate lever 30 and through the link 34, causes the detent lever 32 to disengage from the primary detent 108 of forkbolt 24 which rotates under the force of a conventional forkbolt spring (illustrated in phantom) and releases the striker 16. The forkbolt 24 rotates to the fully opened position as illustrated in FIG. 4.

In cooperation, the cinching gear 42 rotates therewith, which is made possible by the disengagement of pawl 84 and specifically, the cam surface 86 from notch 49, by link 22 which operates as an unlatching rod. Link 22 is driven to hold the pawl 84 out of engagement with the cinching gear 42 by engaging the end 110 of curved slot 94. The link 22 is driven during the manual unlatching process by the intermediate lever 30 which cooperates with the operating lever 50. Manual opening and closing of the liftgate 12 through engagement of the forkbolt 24 with the striker 16 can be repeated indefinitely without calling into play the powered operation of the cinching mechanism 16.

The present invention provides a means of electrically unlatching the latch assembly 14 by means of the cinching mechanism 18. This is initiated by a switch (not illustrated), selectively positioned for operation by the vehicle operator which in combination with the electrical control mechanism supplies power to the motor and gear box assembly 40 causing the actuator 54 to be powered driven in a clockwise direction. This moves the end 112 of opening 68 in actuator 54 to engage link 22 thereby pulling intermediate lever 30 to rotate in a counterclockwise direction.

Intermediate lever 30 includes arm 114 which, in a conventional manner, is optionally used to provide an additional method of releasing the latch assembly 14 such as through an interior handle release mechanism (not illustrated), in addition to the release mechanism supplied through the rod 28 and the operating lever 50. Thereby, through interaction of intermediate lever 30 with conventional componentry (not illustrated), of latch assembly 14 the cinching mechanism 18 automatically releases the latch assembly 14 to a fully opened condition. When the cinching mechanism 18 releases the latch assembly 14, the liftgate 12 may then be fully opened through manual or power means.

By means of the aforementioned structure a combination latch assembly 14 and cinching mechanism 18 are provided wherein manual operation of the latch assembly 14 is possible regardless of the condition of the cinching mechanism 18. Should travel of the cinching mechanism 18, from a standby position to a fully closed position, during cinching operation, be interrupted in a manner such that power to the motor and gearbox assembly 40 is lost, operation of the latch assembly 14 is not defeated.

Accordingly, should such a condition exist, the latch assembly 14 can be released to an unlatched position since manual application of force to the rod 28 will cause the operating lever 50 to pivot and in response, through operation of the link 22 by intermediate lever 30, cause the pawl 84 and the cam surface 86 to disengage from the notch 49 of cinching gear 42. This allows the forkbolt 24 to pivot to the fully opened position. During this operation, the detent lever 32 will be disengaged from the primary detent 108 by link 34. Optionally, the rod 28 can be selectively manually driven by a key cylinder (not illustrated), provided on the exterior of the liftgate 12 or can be driven a manually operated handle (not illustrated), also provided on the exterior side of liftgate 12 which coordinates with a secondary locking device (not illustrated).

In disengaging the pawl 84 from the cinching gear 42 the face 116 of actuator 54, (more clearly shown in FIG. 3), operates with segment 121 of link 22 to hold pawl 84 in a disengaged position from the cinching gear 42 when driven by intermediate lever 30. Should power to the motor and gear box assembly 40 be lost when the maximum cinching force to the latch assembly 14 is applied, then a second face 118, (more clearly shown in FIG. 3), within elongated opening 68 of actuator 54 engages segment 124 and assists in moving link 22 to disengage pawl 84 from cinching gear 42. Regardless of the point of power loss to the motor and gear box assembly 40, the latch assembly 14 remains in a closed position or a substantially closed position until manually opened.

According to the present invention a cinching mechanism is provided which provides substantial force to operate a substantially conventional latch assembly through the use of relatively inexpensive operating components which can be fabricated from conventional materials such as metal or plastic. Since the cinching mechanism requires only limited modifications to the latch assembly itself, a shorter lead time in implementing a cinching mechanism into a latch assembly is possible and since the cinching mechanism itself substantially utilizes components separate from the latch assembly, its shape is readily adaptable to appropriately fit within the application.

What is claimed is:

1. A cinching mechanism for providing automatic operation of a latch assembly comprising:

a cinching gear rotatable about a shaft and operatively interacting with the latch assembly and including a notch radially spaced away from the shaft;

an actuator pivotably coaxially mounted with the cinching gear about the shaft and including an integral extension and an opening radially spaced away from the shaft;

a pin fixed within the opening of the actuator and extending therefrom;

a pawl pivotally mounted on the pin and including a cam surface selectively engaging the notch of the cinching gear to rotate the cinching gear in concert with the actuator and selectively disengaging from the notch to permit relative rotation between the cinching gear and the actuator wherein the pawl additionally operates to lock the cinching gear in a latched position by engaging the notch in the cinching gear; and a plurality of switches interacting with the cinching gear and the extension of the actuator.

2. A cinching mechanism according to claim 1 further comprising a link engaging the pawl and extending to the latch assembly wherein the link is operable to disengage the pawl from the notch of the cinching gear in response to manual unlatching of the latch assembly through rotation of the cinching gear without automatic operation.

3. A cinching mechanism according to claim 2 further comprising a motor operable to drive the actuator and wherein the link is engageable with the actuator and when driven by the motor is operable to automatically unlatch the latch assembly.

4. A cinching mechanism according to claim 3 wherein the cinching gear includes a step and wherein at least one of the switches interacts with the step to initiate automatic operation of the cinching mechanism by initiating power to the motor.

5. A cinching mechanism according to claim 4 wherein at least one of the switches interacts with the extension of the actuator to initiate turning the motor off.

6. A cinching mechanism according to claim 4 wherein the cinching gear is drivable to rotate toward the latched position by the latch assembly wherein the at least one of the switches is operated by the step in response to rotation of the forkbolt.

7. A cinching mechanism in combination with a latch assembly comprising:

a forkbolt pivotably mounted in the latch assembly having a gear section and a primary detent;

a detent lever engageable with the primary detent and operable to lock the forkbolt from rotating;

an operating lever pivotably mounted in the latch assembly;

an intermediate lever engageable with the operating lever;

a cinching gear operatively interacting with the gear section of the forkbolt and including a notch;

an actuator pivotably coaxially mounted with the cinching gear including a top plate with a circular portion having a first face, a base plate having a lobed portion with an elongated opening having an internal second face and an integral extension on the lobed portion with a circular opening extending through the top plate and the base plate;

a pin fixed within the circular opening of the actuator and extending therefrom;

a pawl pivotally mounted on the pin and including a cam surface selectively engaging the notch of the cinching gear;

a spring mounted on the pin and biasing the cam surface toward the cinching gear;

a first link fixedly engaging the detent lever and selectively engaging the intermediate lever;

a second link having a first segment engageable with the first face of the actuator and a second segment engageable with the second face of the actuator;

a first and a second switch interacting with the cinching gear; and a third switch interacting with the extension of the actuator.

* * * * *